US008117768B2

(12) United States Patent
Bobbett

(10) Patent No.: US 8,117,768 B2
(45) Date of Patent: Feb. 21, 2012

(54) ANATOMICAL FOOTWEAR TOEPIECE AND METHOD OF MANUFACTURING THE SAME

(75) Inventor: Jonathan Bobbett, Rye, NH (US)

(73) Assignee: Advanced Manufacturing Group, Ltd., Jordan, Kowloon (CN)

( * ) Notice: Subject to any disclaimer, the term of this patent is extended or adjusted under 35 U.S.C. 154(b) by 802 days.

(21) Appl. No.: 12/179,553

(22) Filed: Jul. 24, 2008

(65) Prior Publication Data

US 2010/0018078 A1 Jan. 28, 2010

(51) Int. Cl.
*A61F 5/14* (2006.01)
*A43B 3/12* (2006.01)

(52) U.S. Cl. ..... 36/94; 36/11.5; D2/916

(58) Field of Classification Search ..... 36/98, 182, 36/141, 11.5, 93, 94; D2/916, 917, 918
See application file for complete search history.

(56) References Cited

U.S. PATENT DOCUMENTS 2,928,191 A * 3/1960 Meltzer ..... 36/94
3,978,596 A * 9/1976 Brown et al. ..... 36/11.5
4,669,142 A * 6/1987 Meyer ..... 12/142 N
4,689,898 A * 9/1987 Fahey ..... 36/43
6,904,706 B2 * 6/2005 Jones et al. ..... 36/11.5
7,131,939 B2 * 11/2006 Ferri ..... 482/148
7,287,342 B2 * 10/2007 Keen ..... 36/50.1
7,603,797 B2 * 10/2009 Chung ..... 36/94
2005/0016018 A1 1/2005 Cagner
2006/0288609 A1 12/2006 Wilkenfeld et al.
2008/0086918 A1 4/2008 Chung

* cited by examiner

*Primary Examiner* — Jila Mohandesi
(74) *Attorney, Agent, or Firm* — Pierce Atwood LLP; Kevin M. Farrell; Katherine A. Wrobel

(57) ABSTRACT

The present invention is an anatomical toepiece that is adapted for insertion into the footbed of a footwear article to provide increased comfort and control. The toepiece has a molded core comprising an anchoring flange for embedded attachment within the footbed of the footwear article. Additionally, the molded core further has an inter-toe engagement portion which extends upwardly from the anchoring flange for engagement between the great toe and the adjacent digit, and a wing which caps the inter-toe engagement portion and extends outwardly in both directions over a portion of the upper forefoot. The inter-toe engagement portion has arcuate curved sidewalls and an arcuate curved back wall to contour to the curvature of an engage foot thereby providing comfort and dexterity.

24 Claims, 5 Drawing Sheets

ANATOMICAL FOOTWEAR TOEPIECE AND METHOD OF MANUFACTURING THE SAME

BACKGROUND OF THE INVENTION

1. Field of the Invention

The present invention relates generally to the field of footwear devices. More particularly, this invention relates to a novel anatomical footwear toepiece that is adapted for integration with an article of footwear for providing stability, comfort and control to a wearer.

2. Discussion of Background Information

Footwear manufacturers continually strive to improve comfort, fashion and functionality of footwear items. Because wearers select footwear based on appearance, comfort and function, footwear apparel must address several criteria such as aesthetics, balance, comfort and control during walking, skating, and other ambulatory-related activities.

The sole and footbed are target areas for innovation, especially concerning footwear articles having limited upper sections and ankle support such as strappy sandals and flip flops having only a V-shaped band element extending atop the wearer's foot. Footwear items having limited upper elements especially lack support elements for cushioning a foot and/or enabling sufficient control. Without proper support, a foot may pronate or supinate, causing the arch to flatten upon impact and that may lead to knee pain and back pain. Additionally, articles of footwear lacking complete uppers fail to restrain a foot sufficiently enough to prevent forward and lateral sliding, which may lead to stubbed toes and/or broken sandal straps.

Some shoe manufactures address balance, comfort and support criteria by adding support to the outsole or between the outsole and footbed. Running sneakers, for example, commonly incorporate gel cushions, springs or air pockets into the heel of the sole for softening the blow when a wearer's foot strikes a solid surface. Too much cushioning, however, may lead to pronation, and manufactures often add interior arch supports to compensate for this. Arch supports in the interior of the footwear article are typically positioned beneath the footbed or are incorporated as an integral part of the footbed. These arch supports therefore occupy substantial volume within the article of footwear. This may lead to wearer discomfort because the reduced interior space causes the top of the foot to abut the shoe upper, restricting circulation and proper flexing of the metatarsals and cuneiform bones positioned in the middle of the foot.

Some sandal and flip flop manufacturers attempt to add cushioning by incorporating soft, formable materials, such as cork and formable gels, into the footbed. These materials indent under pressure from a wearer's foot, forming groves particularly in and around the heel and metatarsals for receiving the foot into a particular position after a sufficient amount of repeated use. Such cushioning materials fail to support a pronating or supinating foot, however, and they also fail to prevent a foot from sliding too far forward or to either side. Sandal wearers often stub toes because of such slippage or step out of their footwear apparel altogether. Some sandal devices incorporate a toe loop for receiving the big toe to prevent the sandal from inadvertently falling off a wearer's foot. Other sandals incorporate ankle straps that wrap around a wearer's ankle, thereby securing the footwear item by a safety strap. These improvements, however, fail to prevent significant lateral movement, and these lose fitting footwear items thus may cause a wearer to trip and/or roll an ankle inward or outward because of an inherent lack of control.

One inexpensive, easily manufactured footwear cushioning and anti-slip device comprises a cushioning gel insert with an adhesive on its underside for securing the device to the footbed. Adhesive backed cushions applied in the metatarsal region may help to prevent forward slippage, but they fail to provide adequate structure for controlling the footwear and preventing injury associate with such lack of control.

A need therefore exists for an easily manufactured device that adds comfort and control to articles of footwear so that a user may balance properly and avoid any injury. Furthermore a need exists for such a device adapted for incorporation particularly within articles of footwear lacking significant structure, such as sandals substantially lacking upper support elements.

SUMMARY OF THE INVENTION

The present invention is directed to an anatomical toepiece that is adapted for insertion into the footbed of a footwear article. One embodiment of the toepiece comprises a core comprising an anchoring flange for embedded attachment within the footbed of the footwear article. Additionally, the core comprises an inter-toe engagement portion which extends upwardly from the anchoring flange for engagement between the great toe and the adjacent digit, and a wing which caps the inter-toe engagement portion and extends outwardly in both directions over a portion of the upper forefoot.

The present invention also is directed to a method of manufacturing an anatomical toepiece that is adapted for insertion into the footbed of a footwear article. One embodiment of the method comprises forming a core comprising an anchoring flange for embedded attachment within the footbed of the footwear article. Additionally, the core comprises an inter-toe engagement portion which extends upwardly from the anchoring flange for engagement between the great toe and the adjacent digit, and a wing which caps the inter-toe engagement portion and extends outwardly in both directions over a portion of the upper forefoot.

DETAILED DESCRIPTION

The present invention resolves the stated deficiencies of footwear apparel. Various features and advantages of the present invention are described below with reference to preferred embodiments and variations thereof. Those skilled in the art, however, will understand that alternative embodiments of the structures and methods illustrated herein may be employed without departing from the scope and principles of the described invention.

Figure 1:
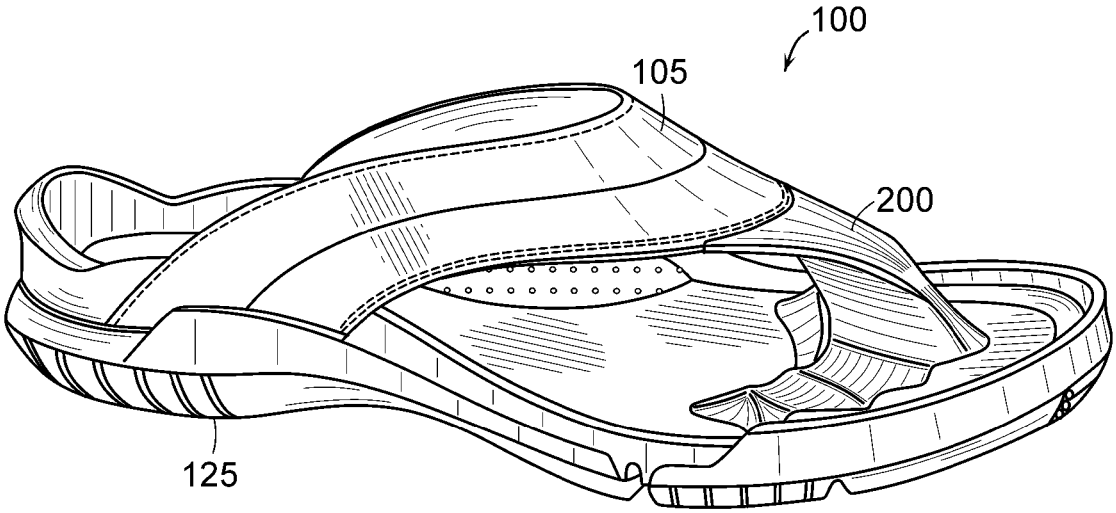
FIG. 1 is a side view of a footwear article incorporating an embodiment of the present invention.
Figure 2:
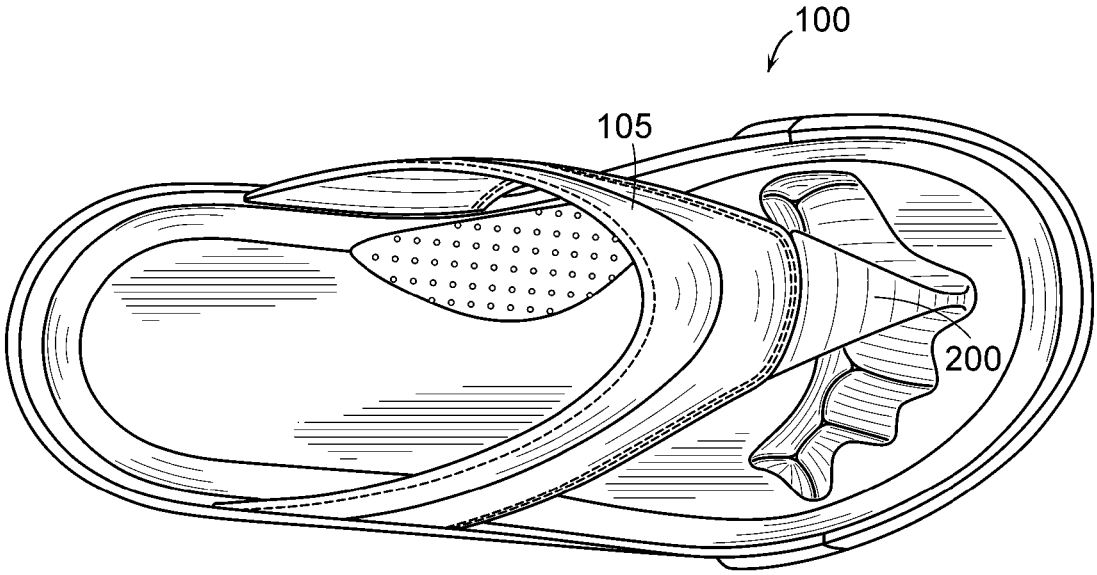
FIG. 2 is a top view of a footwear article incorporating an embodiment of the present invention.

FIGS. 1 and 2 depict an exemplary footwear article 100 incorporating an embodiment of the anatomical toepiece 200 of the present invention. The footwear article 100 of FIGS. 1 and 2 is a flip flop or thong type article having a strap 105 that comprises the upper element and that anchors in two locations, astride the heel portion of the sole and near the toe portion of the sole 125. More particularly, the strap 105 of the footwear article 100 of FIGS. 1 and 2 anchors to the anatomical toepiece 200 in the depicted embodiment.

FIGS. 3A through 3D show the anatomical toepiece in greater detail. The anatomical toepiece 200 comprises three primary portions: (1) a flange portion 205, (2) an intertoe engagement portion 210 and (3) a wing portion 215. These portions may be manufactured as part of a unitary device or as separate and distinct portions adapted for integration with one another and with an article of footwear. For example, each element may be manufactured from distinct materials better suited for comfortable contact with certain portions of a foot. The distinct elements may then be assembled, for example using press fit termini or mechanical fasteners, to form a secure structure suited for reliable use.

In one embodiment, the anatomical toepiece 200 and components thereof may be manufactured from one or more rigid or semi-rigid materials comprised of one or more plastic substrates. For example, the anatomical toepiece 200 may be extruded or molded from one or more plastic substrates such as ethylene vinyl acetate (EVA), polypropylene, acrylonitrile butadiene styrene (ABS), polycarbonate (PC), nylon, propionate, copolyester, PC/ABS, CROSLITE and other engineered plastic blends suitable for use in footwear devices. In one embodiment, the rigid or semi rigid anatomical toepiece 200 is adapted for receiving a comfort coating layer of lower durometer relative to that of the anatomical toepiece 200, and the comfort coating layer at least covers portions of the anatomical toepiece 200 which extend above the footbed 110 for contacting a foot. In one embodiment, perforations in one or more portions of the anatomical toepiece 200 enable the comfort coating layer to penetrate through and around the core for secured attachment. In yet another embodiment, the anatomical toepiece 200 may be made entirely of the comfort coating material. One skilled in the art will recognize than any number of materials are suitable for manufacturing a durable anatomical toepiece having the characteristics herein described.

Figure 4:
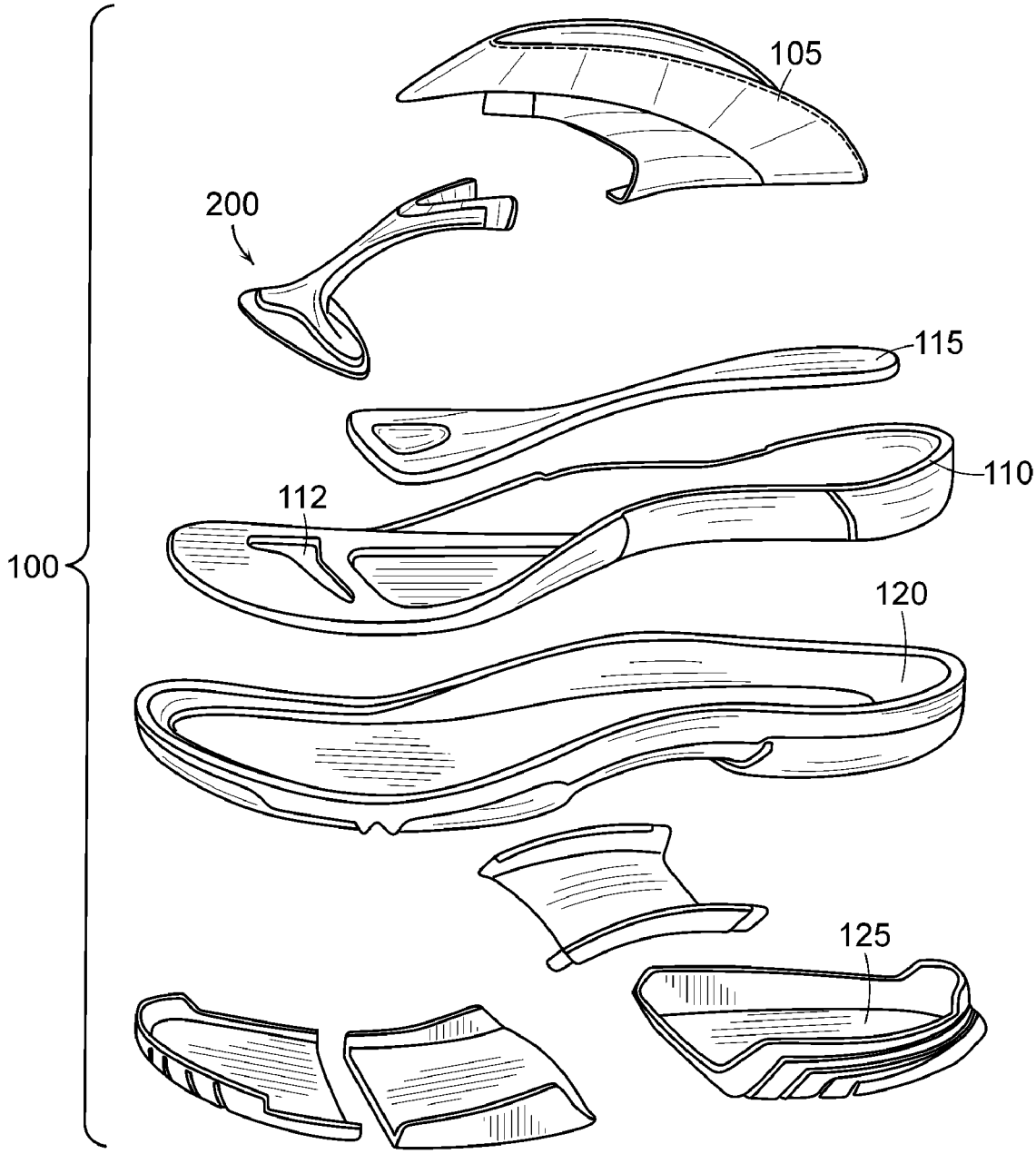
FIG. 4 is an exploded view of a footwear article incorporating an embodiment of the present invention.

Turning now to a description of the elements of a preferred embodiment of the anatomical toepiece 200, the flange portion 205 integrates with the footbed 110 of the footwear article 100 as FIGS. 1 and 4 depict. In the embodiment of FIGS. 1 and 4, the anatomical toepiece 200 is separate and distinct from any optionally added cushion insert 115 adapted for placement beneath the arch and heel of a foot. The footbed 110 has a shaped cutout 112 therein for receiving the flange portion 205 of the anatomical toepiece 200. In this embodiment of the present invention, a bottom surface of the anatomical toepiece 200 rests against a midsole 120 of the footwear article 100, just above the outsole 125. In alternate embodiments, the flange portion 205 may attach to the footwear article 100 by any known fastening means or combination of fastening means compatible with footwear, such as adhesives or mechanical fasteners engaged with any of the footbed 110, midsole 120 and outsole 125.

As FIGS. 3A through 3D show, the flange portion 205 may comprise an upper rim 206 and a lower rim 208 with a recess 207 therebetween. This embodiment of the flange portion 205 is adapted for receiving the footbed 100 into the recesss 207 such that the upper rim 206 is flush with or just above the upper surface of the footbed 110 and the lower rim 208 is flush with or just beneath the lower surface of the footbed 110. In alternate embodiments, the flange portion 205 may comprise only a lower rim 208 that extends outward about part or all of the lower perimeter of the flange portion 205 for sufficient retention of the flange portion 205 between the footbed 110 and the midsole 120 and/or outsole 125.

Just as the flange portion 205 attaches to the footbed 110 of the footwear article 100, the wing portion 215 is adapted for integration with an upper portion of the footwear article 100. In the embodiment of FIGS. 1 and 4, the upper portion is the strap 105 of a sandal. In alternate embodiments, the upper portion attaching to the wing portion 215 may be a tongue or any portion of a footwear upper, such as, for example, a sneaker upper, a scuba fin upper, or a skate upper. The strap 105 of the embodiment shown in FIGS. 1 and 4 is generally V-shaped such that the point of the V attaches to the wing portion 215 and the legs of the V anchor to the footbed 110 and midsole 120. The method for attaching the strap 105 to the wing portion 215 may be via any conventionally known manufacturing technique, such as stitching, riveting, or adhering with adhesives. In the embodiment shown in FIGS. 3A through 3D, the wing portion 215 comprises a lip 217 extending therefrom for integration with the upper portion of the footwear article 100. The lip portion 217 may be integrally formed with the wing portion 215 or may be attached via some fastening means, such as adhesives or mechanical fasteners, for example, rivets, staples or nails. In the embodiment of FIGS. 3A through 3D, the lip 217 is thinner than the wing portion 215 and aligned with the lower surface of the wing portion 215 such that attachment to a footwear upper portion enables alignment of the upper surface of the wing portion 215 with the upper surface of the upper portion. In the embodiment of FIGS. 1 and 2, for example, the lip 217 attaches to the underside of the point of the V formed by the strap 105. The upper surface of the wing portion 215 therefore aligns with the upper surface of the attached strap 105 so as to produce the appearance a continuous upper surface of the footwear article 100.

Figure 3A:
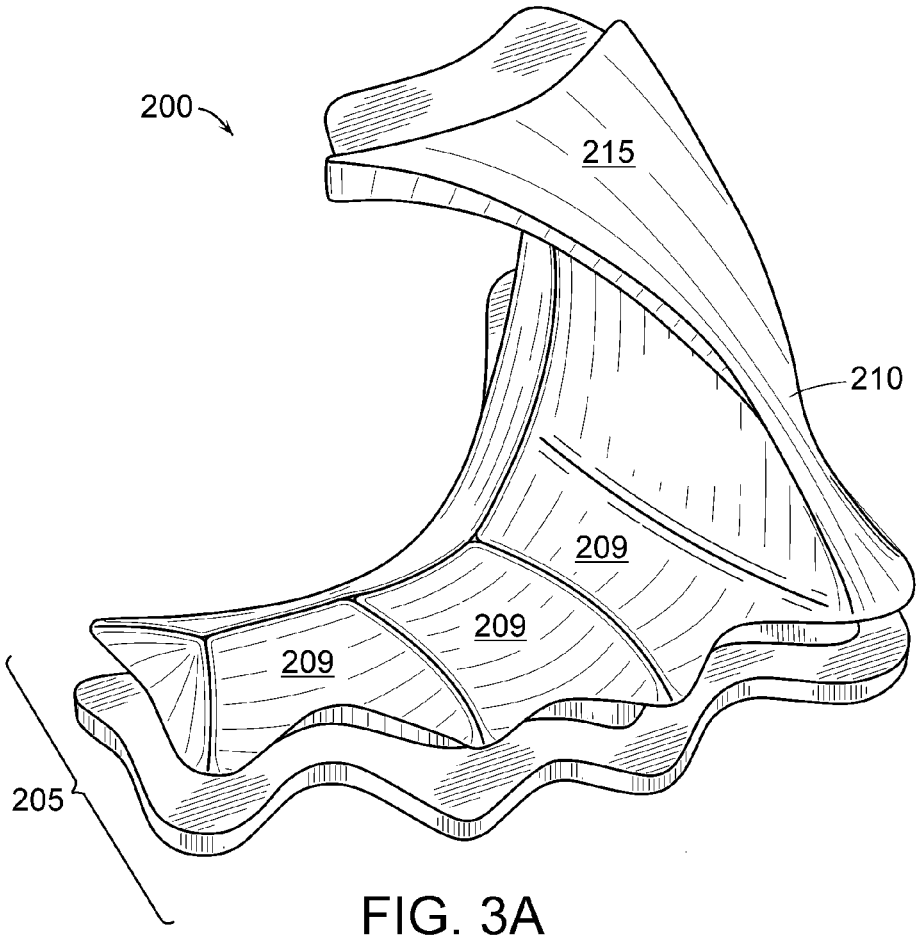
FIG. 3A is a perspective view of an embodiment of the present invention.
Figure 3B:
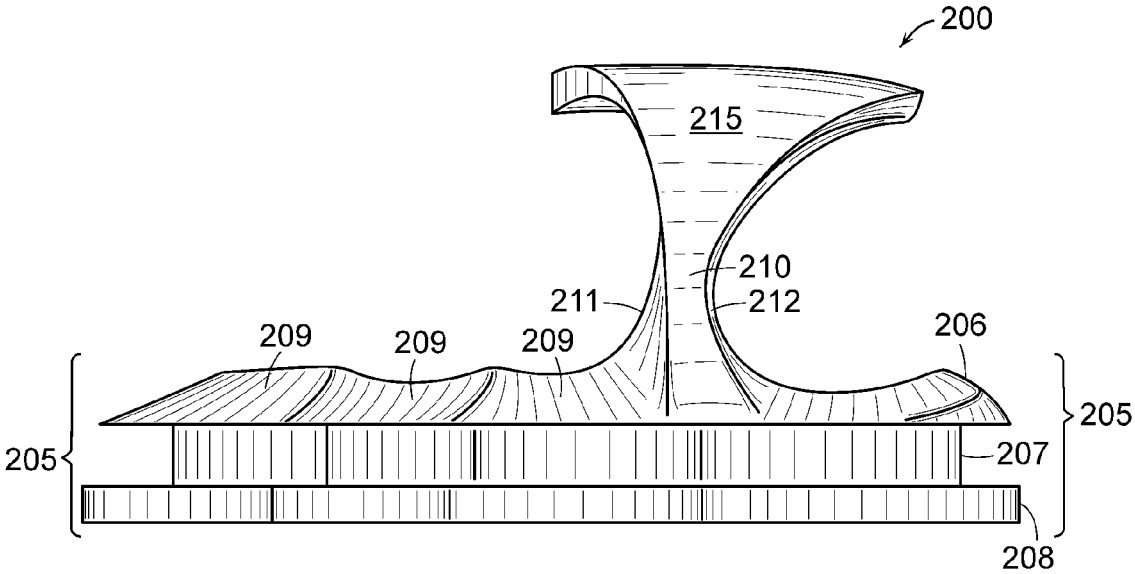
FIG. 3B is a front view of an embodiment of the present invention.
Figure 3C:
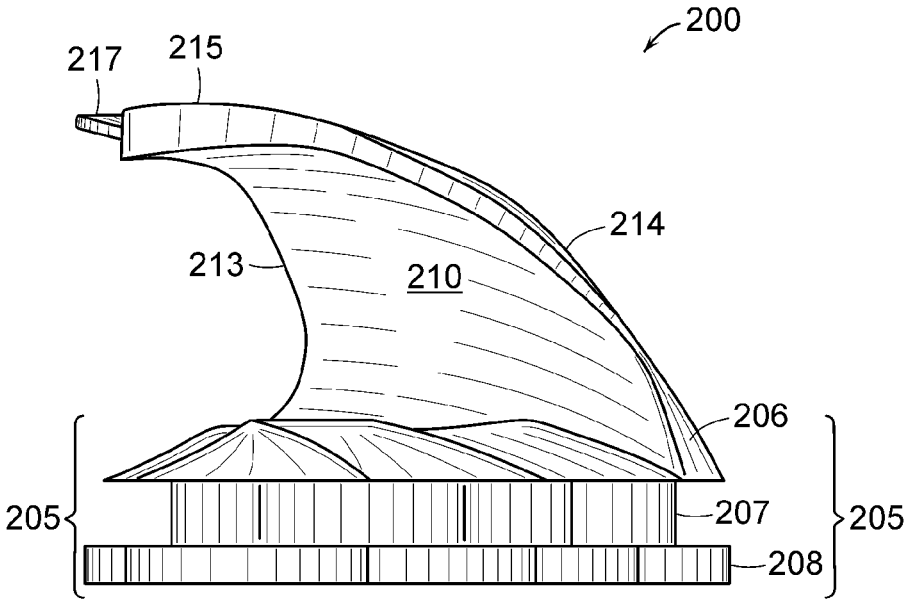
FIG. 3C is a side view of an embodiment of the present invention.
Figure 3D:
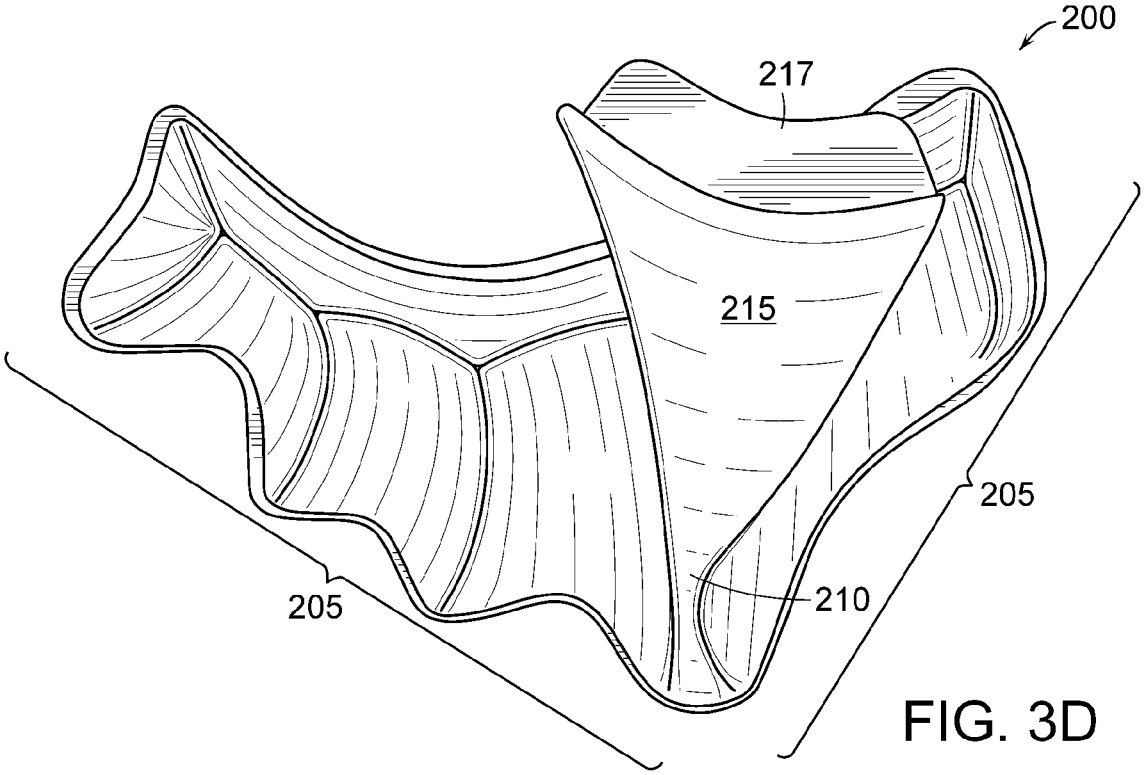
FIG. 3D is a top view of an embodiment of the present invention.

Turning back to the elements of the anatomical toepiece 200, the wing portion 215 connects to the flange portion 205 by the intertoe engagement portion 210. The intertoe engagement portion 210 rises upward from the flange portion 205 integrated with the footbed 110 of the footwear article 100 and terminates at the wing portion 215 designed to rest atop a foot. In one embodiment, the base of the intertoe engagement portion 210 extends the width of the flange portion 205 as shown in FIGS. 3A and 3C. In another embodiment, the base of the intertoe engagement portion 210 may extend only partially across the upper surface of the flange portion 205, as shown in FIG. 4. In every embodiment, the intertoe engagement portion 210 is sufficiently narrow to fit comfortably between one or more toes, for example, between the outermost big toe (referred to herein as the great toe) and the adjacent, second toe.

The base of the embodiment of the intertoe engagement portion 210 shown in FIGS. 3A through 3D extends across the width of the flange portion 210 such that I-beam-like structural strain and stress resistance characteristics apply. This design provides strength in the front to back direction as well as in a lateral direction. The sizeable and sturdy intertoe engagement portion 210 rests against a foot fully inserted into the footwear article 100 and provides sufficient structural strength to prevent the foot from sliding forward on the footbed 110 and disrupting a wearer's balance. Additionally, the substantial surface area contact between the foot and the intertoe engagement portion 210 enables a foot to remain engaged and control the footwear article 100 with substantial dexterity. As described above with regard to materials of manufacture, the intertoe engagement portion 210 may be manufactured from any number of resilient, footwear appropriate materials, including plastic materials or rubber materials, which inherently have favorable coefficients of friction. The surface forces induced by the shape of the intertoe engagement portion 210 engaging with one or more toes and the degree of friction provided by the materials of manufacture combine to create a secure attachment with a foot and improve balance such that a foot is less likely to pronate or supinate.

Other characteristics of an embodiment of the anatomical footwear toepiece 200 add to wearer comfort and reliable engagement with a foot. Each of the three portions of the anatomical toepiece 200 comprises structural characteristics adapted for accommodating the anatomical features of a foot, and those features provide increased comfort and dexterity. As described above, one embodiment of the intertoe engagement portion 210 is structured substantially like an I-beam and resists lateral and front to back stresses applied by an engaged foot. Additionally, the embodiment the intertoe engagement portion 210 shown in FIGS. 3A through 3D provides anatomical contours that mimic the contours of a foot for a precise engagement. As the embodiment of FIG. 3B clearly shows, the instep sidewall 211 and outer sidewall 212 of the intertoe engagement portion 210 are curved in an approximately semi-circular fashion from top to bottom to accommodate the curvature of adjacent toes. Additionally, the instep sidewall 211 is curved to form a wider arc between the flange portion 205 and the wing portion 215 than that of the outer sidewall 212. Accordingly, the wing portion 215, which extends from the intertoe engagement portion 210, tilts from a perfectly horizontal position thereby also accommodating the curvature of the top of a foot and the uneven thickness of a foot. This non-symmetrical configuration mimics the non-symmetrical shape of a foot and ensures a secure and comfortable fit with an engaged foot.

Just as the instep sidewall 211 and outer sidewall 212 are curved from top to bottom, the back surface 213 of the intertoe engagement portion 210 is also curved. As FIG. 3C depicts, the back surface 213 of the intertoe engagement portion 210 is curved in a slanted arc so that the bottom of the arc is closer to the front of the anatomical toepiece 200 than the top of the arc. This back surface 213 therefore mimics the curvature of a foot for a secure, contoured fit. Optionally, the top surface 214 of the intertoe engagement portion 210 may be similarly contoured to create and aesthetically pleasing appearance. This curvature of the back surface 213 enables the wing portion 215 extending from the intertoe engagement portion 210 to rest atop the engaged foot. The distance between the wing portion 215 and the footbed 110 may be sized according to standard foot thickness measurements so that a wearer's foot securely and comfortably engages between the footbed 110 and the wing portion 215. The retention force provided by this dimensioning adds to the footwear control capabilities imparted by the anatomical toepiece 200. The contoured engagement and secure fit between the anatomical toepiece 200 and a foot enables a wearer to remain balanced and securely in control of the footwear article during use.

Figure 5A:
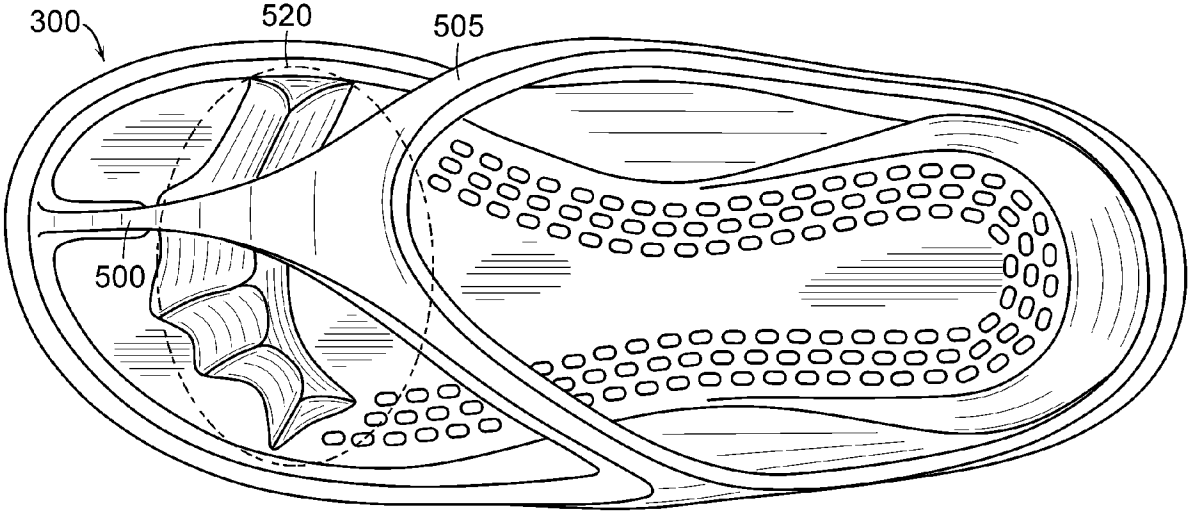
FIG. 5A is a top view of a footwear article incorporating another embodiment of the present invention.
Figure 5B:
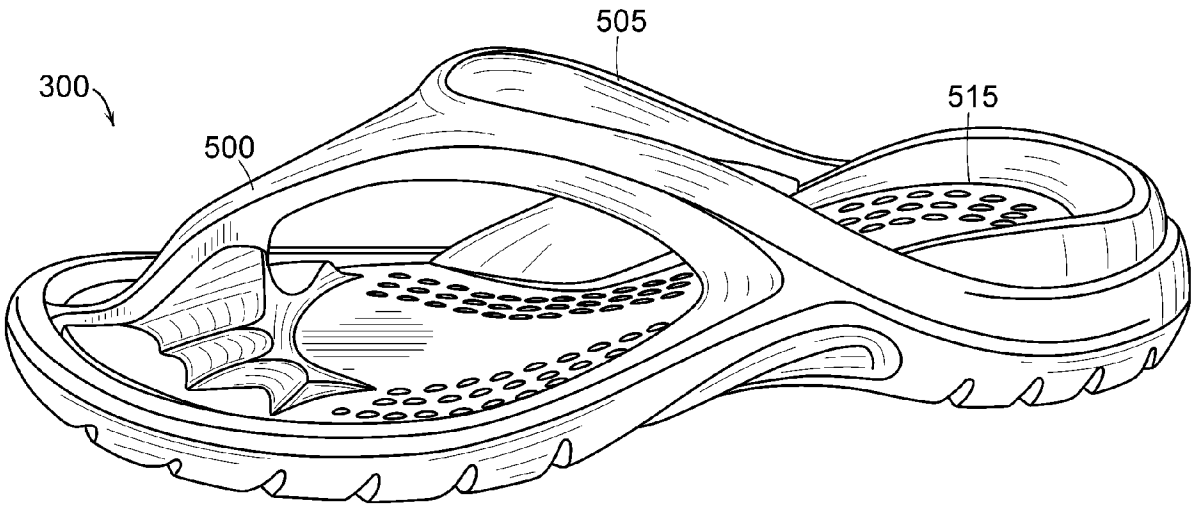
FIG. 5B is a side view of a footwear article incorporating another embodiment of the present invention.

In addition to the contours of the intertoe engagement portion 210 and the wing portion 215, the flange portion 205 also provides anatomical support. The flange portion extends laterally across the footbed 110 in a configuration designed to receive and support the toes and forward foot joints. As the top view of the embodiment of the anatomical toepiece 200 in FIG. 3D clearly depicts, the flange portion 205 may extend from the intersection with the intertoe engagement portion 210 in a curvilinear manner so as to form a crescent shape beneath the toes of a foot. The flange portion 205 thereby aligns with and supports the non-linear distribution of the toes and metatarsal joints of a foot for accurate support. Additionally, the flange portion 205 of the embodiment of FIGS. 3A through 3D is distributed unevenly about the intersection with the intertoe engagement portion 210 and extends precisely beneath only the great toe on one side and the other four toes on the other side of the intertoe engagement portion 210. One skilled in the art will note that such precise shaping and elongation are a matter of both form and function and that alternate configurations of the flange portion 205 are conceivable. For example, the flange portion 205 may be a simple rectangle or make extend the length of the footbed or may be formed as a unitary piece with the footbed and/or upper portions, as shown in the embodiment of FIGS. 5A and 5B.

Additionally, in one embodiment, the flange portion 205 comprises a support ridge positioned above the footbed and extending across the anchoring flange and optionally extending across the inter-toe engagement portion in other embodiments. The support ridge is adapted for proper sizing and positioning on the flange portion so as to support the toes. In one embodiment, the support ridge supports the middle phalanges of the toes other than the great toe, and the interphalangeal joint of the great toe. In the embodiment shown in FIGS. 3A through 3D, the support ridge comprises a series of anatomically contoured toe indentations 209. In other embodiments, the support ridge may be a single raised ridge extending laterally across the flange portion 205 to enable gripping. The support ridge or contoured toe indentations 209 may be formed directly on the flange portion 205 or within the overmold material provided for added comfort in those embodiments having an overmold. For example, FIGS. 3A though 3D depict an embodiment made entirely of a single plastics material having the toe indentations 209 formed therein. In contrast, FIG. 5 depicts an anatomical toepiece 500 formed integrally with a footbed 510 and upper strap 505 and having an overmold insert 515 thereon bearing toe support ridges 520 formed preferably from a cushioning material of lower durometer than the anatomical toepiece 500.

The embodiments of the anatomical toepiece 200 therefore incorporate several critical elements for fitted support that improves wearer comfort in addition to improving balance and control of the footwear article. The anatomical toepiece 200 further is adapted for proper anatomical engagement with each foot, the left and the right. Additionally, the anatomical toepiece 200 may be sized to fit different sized feet and the curvatures may be altered to compensate for feet with higher or lower rises and greater or lesser thicknesses. These considerations address differences between male and female bone structure, and adult and child anatomical differences.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; Rather, the present invention extends to all functionally equivalent structures, methods and uses, such as are within the scope of the appended claims.

I claim:

1. An anatomical toepiece for insertion into the footbed of a footwear article, the toepiece comprising:

a) a molded core comprising:

i) an anchoring flange for embedded attachment within the footbed of the footwear article;

ii) an inter-toe engagement portion which extends upwardly from the anchoring flange for engagement between the great toe and the adjacent digit; and iii) a wing which caps the inter-toe engagement portion, wherein II) the inter-toe engagement portion has an instep sidewall curved in an arc from top to bottom to mimic the contour of the digit adjacent the great toe and an outer sidewall curved in an arc from top to bottom to mimic the curved contour of the great toe, and III) a back surface curved to contour to the curvature of a foot and forming a slanted arc such that the bottom of the arc is adjacent the front of the foot wear article and the wing portion capping the inter-toe engagement portion rests atop the foot, extending outwardly in both directions over a portion of the upper forefoot.

2. The anatomical toepiece of claim 1 wherein the molded core is semi-rigid.

3. The anatomical toepiece of claim 1 wherein the molded core is comprised of one or more plastic substrates.

4. The anatomical toepiece of claim 3 wherein the one or more plastic substrates are selected from the group consisting of ethylene vinyl acetate (EVA), polypropylene, acrylonitrile butadiene styrene (ABS), polycarbonate, nylon and propionate copolyester.

5. The anatomical toepiece of claim 1 wherein the wing which caps the inter-toe engagement portion is adapted for fixed attachment to an overfoot portion of the footwear article.

6. The anatomical toepiece of claim 1 further comprising:

a) a comfort coating layer of lower durometer relative to that of the molded core, the comfort coating layer applied to portions of the anatomical toepiece which extend above the footbed.

7. The anatomical toepiece of claim 6 wherein the comfort coating comprises a thermoplastic elastomer overmold.

8. The anatomical toepiece of claim 1 wherein the molded core further comprises:

a) a support ridge positioned above the footbed and extending across the anchoring flange and inter-toe engagement portion, the support ridge being sized and positioned to support the middle phalanges of the toes other than the great toe, and the interphalangeal joint of the great toe.

9. The anatomical toepiece of claim 8 further comprising a comfort coating layer on the upper surface of the support ridge.

10. The anatomical toepiece of claim 9 wherein the comfort coating comprises a thermoplastic elastomer overmold.

11. The anatomical toepiece of claim 1 wherein the footwear article is an open-toe sandal.

12. The anatomical toepiece of claim 1 wherein the footwear article is an athletic shoe or skate.

13. A method of manufacturing an anatomical toepiece for insertion into the footbed of a footwear article, the toepiece comprising:

a) forming a molded core comprising:

iv) an anchoring flange for embedded attachment within the footbed of the footwear article;

v) an inter-toe engagement portion which extends upwardly from the anchoring flange for engagement between the great toe and the adjacent digit; and vi) a wing which caps the inter-toe engagement portion, wherein II) the inter-toe engagement portion has an instep sidewall curved in an arc from top to bottom to mimic the contour of the digit adjacent the great toe and an outer sidewall curved in an arc from top to bottom to mimic the curved contour of the great toe, and III) a back surface curved to contour to the curvature of a foot and forming a slanted arc such that the bottom of the arc is adjacent the front of the foot wear article and the wing portion capping the inter-toe engagement portion rests atop the foot, extending outwardly in both directions over a portion of the upper forefoot.

14. The method of claim 13 wherein the molded core is semi-rigid.

15. The method of claim 13 wherein the molded core is comprised of one or more plastic substrates.

16. The method of claim 15 wherein the one or more plastic substrates are selected from the group consisting of ethylene vinyl acetate (EVA), polypropylene, acrylonitrile butadiene styrene (ABS), polycarbonate, nylon and propionate copolyester.

17. The method of claim 13 wherein the wing which caps the inter-toe engagement portion is adapted for fixed attachment to an overfoot portion of the footwear article.

18. The method of claim 13 further comprising:

a) applying a comfort coating layer of lower durometer relative to that of the molded core to portions of the anatomical toepiece which extend above the footbed.

19. The method of claim 18 wherein the comfort coating comprises a thermoplastic elastomer overmold.

20. The method of claim 13 further comprising:

a) positioning a support ridge above the footbed and extending across the anchoring flange and inter-toe engagement portion, the support ridge being sized and positioned to support the middle phalanges of the toes other than the great toe, and the interphalangeal joint of the great toe.

21. The method of claim 20 further comprising a comfort coating layer on the upper surface of the support ridge.

22. The method of claim 21 wherein the comfort coating comprises a thermoplastic elastomer overmold.

23. The method of claim 13 wherein the footwear article is an open-toe sandal.

24. The method of claim 13 wherein the footwear article is an athletic shoe or skate.

* * * * *